US006518546B2

(12) United States Patent
Otsuka et al.

(10) Patent No.: US 6,518,546 B2
(45) Date of Patent: Feb. 11, 2003

(54) HEATER HAVING ELECTRONICALLY CONDUCTIVE BOARD AND IMAGE HEATING APPARATUS USING HEATER

(75) Inventors: Yasumasa Otsuka, Kanagawa (JP); Takashi Soya, Chiba (JP); Ken Murooka, Ibaraki (JP); Masahide Hirai, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/899,023

(22) Filed: Jul. 6, 2001

(65) Prior Publication Data

US 2002/0020693 A1 Feb. 21, 2002

(30) Foreign Application Priority Data

Jul. 10, 2000 (JP) ..... 2000-208682

(51) Int. Cl.[7] ..... G03G 15/20
(52) U.S. Cl. ..... 219/216; 399/329; 399/333
(58) Field of Search ..... 219/216, 469; 399/329, 333, 338

(56) References Cited

U.S. PATENT DOCUMENTS

| | | | | |
|---|---|---|---|---|
| 5,083,168 | A | 1/1992 | Kusaka et al. | 355/285 |
| 5,149,941 | A | 9/1992 | Hirabayashi et al. | 219/216 |
| 5,210,579 | A | 5/1993 | Setoriyama et al. | 355/285 |
| 5,262,834 | A | 11/1993 | Kusaka et al. | 355/285 |
| 5,525,775 | A | 6/1996 | Setoriyama et al. | 355/282 |
| 5,697,037 | A | 12/1997 | Yano et al. | 355/282 |
| 5,761,574 | A | 6/1998 | Murooka | 399/181 |
| 5,874,710 | A | 2/1999 | Yoshimoto et al. | 219/216 |
| 5,906,762 | A | 5/1999 | Okabayashi | 219/216 |
| 6,094,559 | A | 7/2000 | Otsuka et al. | 399/68 |
| 6,175,699 | B1 | 1/2001 | Kato et al. | 399/69 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-204980 | 7/1992 |
| JP | 9-244442 | 9/1997 |
| JP | 10-275671 | 10/1998 |
| JP | 10-293490 | 11/1998 |

*Primary Examiner*—Joseph Pelham
(74) *Attorney, Agent, or Firm*—Fitzpatrick, Cella, Harper & Scinto

(57) ABSTRACT

This specification discloses a heater comprising an electrically conductive substrate, a first electrically insulating layer formed on the electrically conductive substrate, a heat generating resistor formed on the first electrically insulating layer, and a second electrically insulating layer formed on the heat generating resistor, wherein when the glass transition temperature of the first electrically insulating layer is defined as T1 and the glass transition temperature of the heat generating resistor is defined as T2 and the glass transition temperature of the second electrically insulating layer is defined as T3, T1, T2 and T3 have the relation that T1>T3≧T2 or T1>T2≧T3. The specification also discloses an image heating apparatus using such heater.

11 Claims, 6 Drawing Sheets

IN THE CONDITION THE HEATER IS OUT OF CONTROL

BURNING OUT OF A PART OF RESISTIVE ELEMENT PATTERN

HEATER HAVING ELECTRONICALLY CONDUCTIVE BOARD AND IMAGE HEATING APPARATUS USING HEATER

BACKGROUND OF THE INVENTION

1. Field of the Invention

This invention relates to a heater which will be effective if used in a fixing device for heating and fixing a toner image formed on a recording material, and an image heating apparatus using this heater.

2. Related Background Art

An image heating fixing apparatus for heat fixing of a toner image formed on a recording material is described below as an example of an image heating apparatus.

In an image forming apparatus such as a copier, printer, or facsimile, an image heating fixing apparatus is a heating apparatus for heating/fixing-processing, on a recording material surface, an unfixed toner image corresponding to image information formed on the surface of a recording material (electro fax sheet, electrostatic recording sheet, transferring material sheet, print paper, or the like) in a direct or indirect (transferring) system using toner made of a thermomeltable resin or the like by proper image forming process means such as electrophotography, electrostatic recording, magnetic recording, or the like.

Conventionally, for such an image heating fixing apparatus, a heat roller system has been widely used. The heat roller system is a system which has a basic construction comprising a metallic roller provided therein with a heater, and a pressure roller having an elasticity and pressure-contacted to said roller, and in which, by passing a recording material through a fixing nip portion formed by one pair of these rollers, an unfixed toner image bore on said recording material is heated and pressurized to fix.

However, in the above heat roller system, since the heat capacity of the roller is large, very much time was required for raising the roller surface to a desired fixing temperature. Besides, for this reason, for quickly executing an image output operation, there is a problem wherein the roller surface must be temperature-adjusted to a temperature in a certain extent even when a machine is not used.

One improved and devised on that point is disclosed in Japanese Patent Application Laid-open No. 10-293490. This is composed by an insulating layer and a heat generation layer are laminated on a surface of a metallic roller. Such a roller is difficult in manufacture, besides, since a contact point for supplying an electric power to the roller slides, problems such as generation of noise and a short duration arise, so it does not reach a practical use in practice.

So, the present applicant has proposed before a heating apparatus of a film heating system (for example, see Japanese Patent Application Laid-open No. 63-313182, Japanese Patent Application Laid-open No. 2-157878, Japanese Patent Application Laid-open No. 4-44075, and Japanese Patent Application Laid-open No. 4-204980.

This film heating system is a system in which a heater and a material to be heated are respectively put on one surface side and the other surface side of a heat-resisting film so as to give the thermal energy of the heating body to the heated material through the heat-resisting film, and a heating apparatus of an on-demand type in which members of low heat capacity can be used for the heating body and film, there is quick startability, and the power consumption in standby is considerably small, can be constructed.

FIGS. 7A to 7C show one example of a heating apparatus of the film heating system. This example is an image heating fixing apparatus of the film heating system. FIG. 7A is an enlarged cross-section model view of a principal part, FIG. 7B is a partially cut-off plan model view on the surface side of a heating body, and FIG. 7C is a plan model view on the back surface side of the heating body.

Reference numeral 7 denotes a heater, which is a slender and thin-plate-shaped member whose longitude is a vertical direction to the drawing surface of FIG. 7A, entirely low heat capacitive, and generates heat by being electrified.

Reference numeral 13 denotes a heater support member, whose longitude corresponds to a vertical direction to a drawing surface of FIG. 7A, being adiabatic and rigid. On the lower surface side of this support member 13, along the member longitude, a seat gouged portion 13*a* elongating in the longitudinal axis and in shallow grooved shape into which the above heater 7 can be fitted is comprised, and the heater 7 is fitted into this seat gouged portion 13*a* and supported by the support member 13.

Reference numeral 12 denotes a thin heat-resisting film and reference numeral 9 denotes an elastic pressure roller. The film 12 is put between the heater 7 supported by the support member 13 and the pressure roller 9 so that a fixing nip portion (heating nip portion) N is formed by contacting and providing a predetermined pressure force with each other.

The film 12 moves in an arrow direction with close contacting the fixing nip portion N to the surface on the downward facing side of the heater 7 and sliding by a not-shown drive member, or the pressure roller 9 being rotation-driven.

And, when a paper leaf body (recording material) 11 carrying an unfixed toner image 10, as a heated material, is introduced between the film 12 of the above fixing nip portion N and the pressure roller 9, the paper leaf body 11 is sandwich-conveyed in the fixing nip portion N together with the film 12 and heated by heat from the heater 7 through the film 12, and unfixed toner 10 is heat-fixed on the paper leaf body surface. The paper leaf body 11 passed through the fixing nip portion N is separated from the surface of the film 12 and conveyed.

Generally, a ceramic heater in which a ceramic board a heating body board having electrical-insulating performance, good heat conductivity and heat-resistivity is used as the heater 7. In this embodiment, a ceramic heater is also used as the heater 7.

That is, numeral 1 denotes a slender and thin-plate-shaped ceramic board.

Reference numeral 2 denotes first and second parallel two-stripe narrow-band-shape electrification heat-generation resistor patterns (one is a first, the other is a second) formed and comprised along the board longitude on the surface side of this ceramic board 1.

Reference numeral 5 denotes two conductor patterns (one is a first, the other is a second) as the first and second power supply electrodes (electrode contact points) formed and comprised with being arranged on the longitude one end portion side of the ceramic board surface. The first power supply electrode 5 is electrically conducted to one end portion of the first resistor pattern 2 through an extension pattern portion. Besides, the second power supply electrode 5 is electrically conducted to one end portion of the second resistor pattern 2 through an extension pattern portion.

Reference numeral 6 denotes a conductor pattern as a folded-back electrode formed and comprised on the ceramic board surface by electrically conducting between the other end portions of the first and second resistor patterns 2.

Reference numeral 3 denotes a heater surface protective glass layer, which is formed and comprised to cover substantially entirely the heater surface except the portion of the first and second power supply electrodes 5. By this protective glass layer 3, each extension pattern portion of the first and second resistor patterns 2 and the first and second power supply electrodes 5, and the folded-back electrode 6 are protected by being covered.

Reference numeral 4 denotes a temperature sensing element such as a thermistor or the like, which is disposed by being contacted to substantially the center portion in the longitudinal direction on the heater back surface side, that is, the back surface side of the ceramic board 1.

The surface side having the surface protective glass layer 3 of the above ceramic heater 7 is the film sliding surface side, and the surface side of this ceramic heater 7 is exposed to the exterior and fitted in the seat gouged portion 13*a* on the lower surface side of said support member 13 and disposed.

Reference numeral 8 denotes a power supply connecter. By predetermined fitness to the power supply connecter mounting portion of the support member 13 disposing and supporting the heater 7, first and second power supply spring contact points 8*a* on the power supply connecter 8 side are pressurized and contacted to the first and second power supply electrodes 5 of the heater 7, and the heater 7 and a not-shown power supply circuit are electrically connected.

By performing power supply from the power supply circuit through the power supply connecter 8 to the first and second power supply electrodes 5, by the electrification heat-generation resistor patterns 2 generating heat throughout the longitude entire length, the heater 7 rapidly raises the temperature. And, the temperature rising information is converted into voltage information by the temperature sensing element 7 disposed on the heater back surface side and detected, the output is calculated by a not-shown control circuit such as CPU or the like, and an AC input from the power supply circuit to the heater 7 is adjusted so that the temperature of the heater 7 is temperature-controlled to a predetermined temperature.

In the fixing apparatus adopting such a film heating system, since the film 12 of a low heat capacity and the heater 7 can be used, it becomes possible to shorten a wait time (quick start) as compared with the conventional heat roller system. Besides, since the quick start can be done, pre-heating upon non-print operation becomes unnecessary, and power-saving in a synthetic meaning can be intended.

By the way, as the ceramic heater of the above-described example, the heating body using the ceramic board such as alumina as the board has the problems that the ceramic is fragile, or, the cost is high, it is unsuitable for bending processing or the like, and the like.

So, in Japanese Patent Application Laid-open No. 9-244442, Japanese Patent Application Laid-open No. 10-275671, a heating body (hereinafter, referred to as conductive board heater) in which, by forming an insulating layer on a metal, a board having the same insulation ability as the conventional ceramic board is made, and a resistor pattern, a conductor pattern, and an insulating sliding layer of the uppermost layer are formed thereon is proposed.

Now, as a countermeasure in which the heater is out of control, i.e., a safety countermeasure for the excessive temperature rise of the heater due to the occurrence of the situation in which the supply of electric power to the heater does not stop and the heater continues to generate heat when a temperature detecting element goes wrong or a control device goes wrong, there is a construction which is provided with a safety countermeasure element such as a thermoswitch or a temperature fuse and in which during the no thermal control of the heater, the power supply circuit to the heater is urgently cut off by the operation of the safety countermeasure element.

In addition, when the heater is a heater using a ceramic board such as alumina, the ceramic board cannot stand thermal stress against the excessive temperature rise of the heater during the no thermal control and causes crack, and with this crack of the board, a resistive element pattern and a conductor pattern are also broken (the self-breakage of the heater when the heater is out of control) and at that point of time, the supply of electric power to the heater stops, and this becomes a dual safety countermeasure.

In the case that a conductive board heater is used, however, the cut-off of the supply of electric power to the heater by the crack of the board when the heater is out of control could not be expected.

SUMMARY OF THE INVENTION

The present invention has been made in view of the above-noted problem and an object thereof is to provide a heater which is high in safety and an image heating apparatus using this heater.

Another object of the present invention is to provide a heater contrived so that a heat generating resistive element may be self-broken when the heater has abnormally risen in temperature and an image heating apparatus using this heater.

Still another object of the present invention is to provide a heater comprising:

an electrically conductive substrate;

a first electrically insulating layer formed on the electrically conductive substrate;

a heat generating resistor formed on the first electrically insulating layer; and a second electrically insulating layer formed on the heat generating resistor;

wherein when the glass transition temperature of the first electrically insulating layer is defined as T1 and the glass transition temperature of the heat generating resistor is defined as T2 and the glass transition temperature of the second electrically insulating layer is defined as T3, T1, T2 and T3 have the relation that $T1>T3\geqq T2$ or $T1>T2\geqq T3$.

Yet still another object of the present invention is to provide an image heating apparatus comprising:

a heater comprising an electrically conductive substrate, a first electrically insulating layer formed on the electrically conductive substrate, a heat generating resistor formed on the first electrically insulating layer, and a second electrically insulating layer formed on the heat generating resistor;

wherein when the glass transition temperature of the first electrically insulating layer is defined as T1 and the glass transition temperature of the heat generating resistor is defined as T2 and the glass transition temperature of the second electrically insulating layer is defined as T3, T1, T2 and T3 have the relation that $T1>T3\geqq T2$ or $T1>T\geqq T3$; and a backup member for forming nip cooperation with the heater.

Further objects of the present invention will become apparent from the following detailed description when read with reference to the accompanying drawings.

DESCRIPTION OF THE PREFERRED EMBODIMENTS

Embodiment 1 (FIG. 1 to FIG. 5)

(1) Example of Image Forming Apparatus

Figure 1:
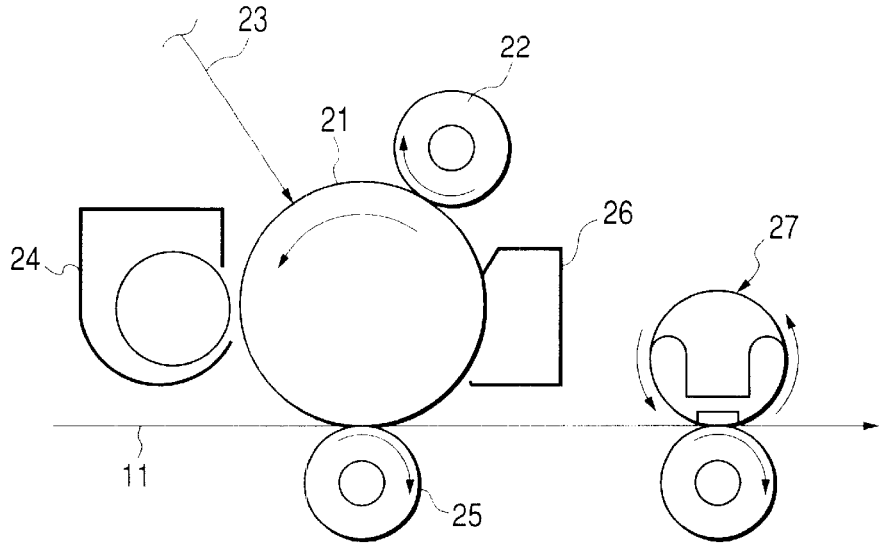
FIG. 1 is a model view schematically showing the construction of an example of an image forming apparatus.

FIG. 1 is a schematic construction model view of one example of an image forming apparatus. The image forming apparatus of this example is a copier or printer utilizing a transferring type electrophotographic process, or a facsimile.

Reference numeral 21 denotes a drum-shape electrophotographic photosensitive body, which is rotated and driven counterclockwise of an arrow at a predetermined peripheral speed.

Reference numeral 22 denotes a charging roller, which is abutted on the photosensitive body 21 with a predetermined pressurizing force, and to which a predetermined charging bias is applied from a not-shown power source portion, thereby evenly charging processing the peripheral surface of the rotating photosensitive body 21 to a predetermined polarity and potential.

By performing image exposure 23 to the charging processing surface of the photosensitive body 21 by not-shown image exposure means (manuscript image projecting means, laser beam scanner, or the like), an electrostatic latent image corresponding to an exposure image pattern is formed on the photosensitive body surface. Reference numeral 24 denotes a developing apparatus, in which the electrostatic latent image on the photosensitive body surface is normal-developed or reverse-developed as a toner image.

Reference numeral 25 denotes a transferring roller, which is abutted on the photosensitive body 21 with a predetermined pressurizing force to form a transferring nip portion. By paper-feeding a transferring material sheet (leaf body) 11 to the transferring nip portion from a not-shown paper feeding portion at a predetermined timing, and applying a predetermined transferring bias to the transferring roller 25 from a not-shown power source portion, toner images on the photosensitive body 21 side are transferred in order to the surface side of the transferring material sheet 11 paper-fed to the transferring nip portion.

The transferring material sheet 11 passing through the transferring nip portion is separated from the photosensitive body 21 surface, conveyed to an image heating fixing apparatus 27, receives heat fixing processing of a carrying unfixed toner image, and paper-discharged.

Besides, the photosensitive body surface after the transferring material sheet separation receives removal of adhering remaining materials such as transferring remaining toner or the like by a cleaning apparatus 26 to be a pure surface, and is repeatedly subjected to image formation.

(2) Image Heating Fixing Apparatus 27

Figure 2:
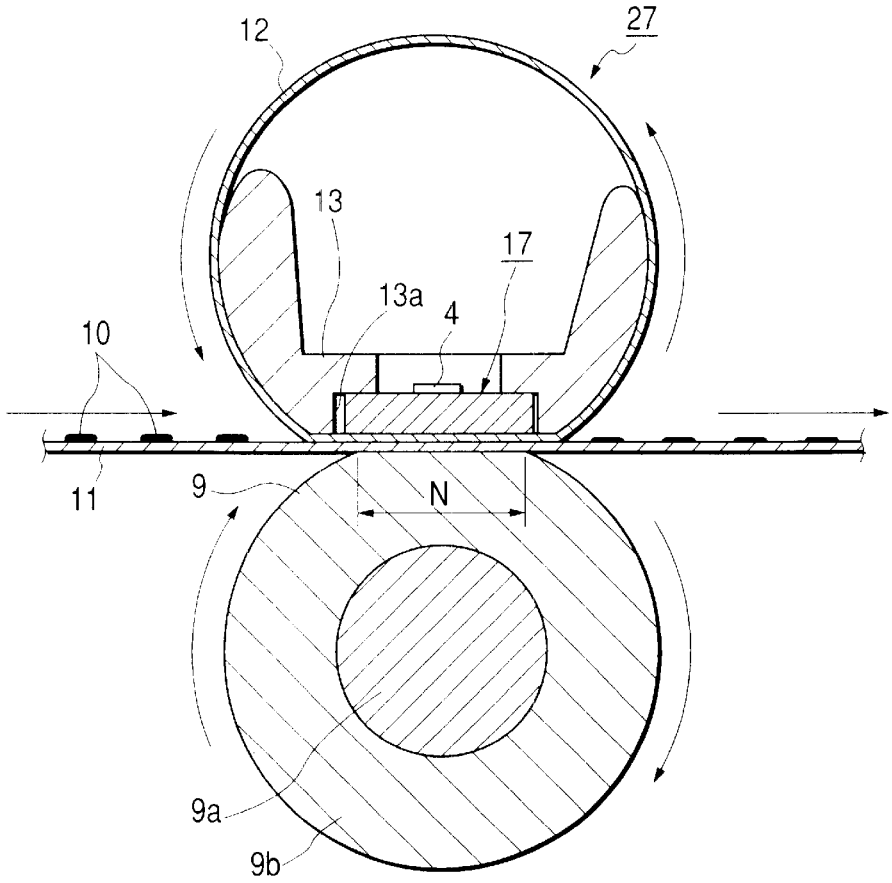
FIG. 2 is a model view schematically showing the construction of a fixing device.

The image heating fixing apparatus 27 of this embodiment is a heating apparatus utilizing a pressure roller drive type or a tensionless type of film heating system. FIG. 2 is a schematic construction view of the apparatus.

Reference numeral 17 denotes a conductive board heater as a heating body according to the present invention, which is a member slender and thin plate shape with a longitude in a vertical direction to the drawing and wholly low heat capacitive. The structure of this heater 17 will be described in detail in the next section (3).

Figure 4:
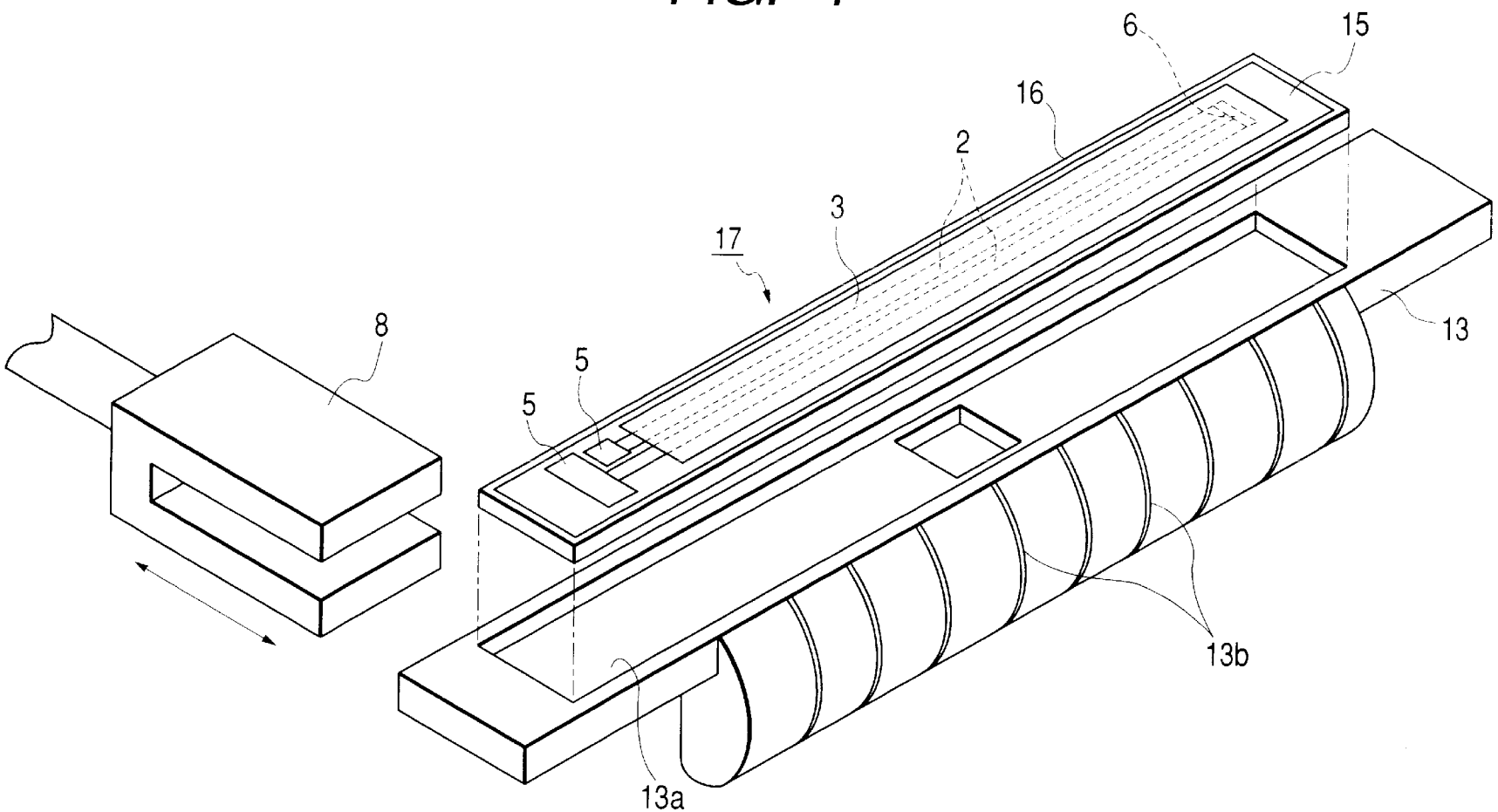
FIG. 4 is an exploded perspective model view of the heater and a stay.

Reference numeral 13 denotes a heating body support member of a substantially semicircular conduit shape in cross section (hereinafter, referred to as a stay), which is a member having heat resistibility and rigidity. On the lower surface side of this stay 13, along the stay longitude, a slender and bottom shallow groove shape seat gouged portion 13*a* into which the above conductive board heater 17 is fitted is comprised, and the conductive board heater 17 is fitted into this seat gouged portion 13*a* and supported by the stay 13. FIG. 4 shows an exploded perspective model view of a stay 13 and a conductive board heater 17. A heat resisting resin like PPS, a liquid crystal polymer or a phenolic resin, including a glass material to increase strength, is used for a material of the stay 13. The stay 13 is formed by injected those materials into a forming die.

Reference numeral 12 denotes a cylindrical thin heat-resisting film (fixing film), which is loosely outside-fitted to the stay 13 in which the heater 17 is disposed.

Reference numeral 9 denotes an elastic pressure roller as a pressure rotor. It comprises a core metal 9*a*, and a rubber elastic layer 9*b* good in mold release ability such as silicone rubber provided concentrically with said core metal 9*a*, and both end portions of the core metal 9*a* are supported through a bearing between not-shown chassis side plates of the apparatus to be free in rotation, respectively.

On the upper side of this pressure roller 9, the above heater 17 is disposed, the stay 13 on which the cylindrical film 12 is outside-fitted is oppositely disposed with the heater 17 side facing downward, a pushing-down force is made to act on the stay 13 by not-shown biasing means, and the facing-down surface of the heater 17 is pressurized and contacted to the upper surface of the pressure roller 9 with sandwiching the film 12 by a predetermined pressurizing force against the elasticity of the rubber elastic layer 9*b*. Thereby, the film 12 is put between the heater 17 and the elastic pressure roller 9 and a fixing nip portion N of a predetermined width is formed.

The pressure roller 9 is rotated and driven clockwise by not-shown drive means at a predetermined peripheral speed. A rotational force acts on the cylindrical film 12 by the pressure contact frictional force in the fixing nip portion N between the outer surface of said roller and the outer surface of the film 12 by the rotation of this pressure roller 9, and said film 12 becomes in a rotation state around the outside of the stay 13 with a peripheral speed substantially corresponding to the rotational peripheral speed to the pressure roller counterclockwise of an arrow with its inner surface is closely contacted and slid with the facing-down surface of the heater 17 in the fixing nip portion N (a pressure roller drive system).

The stay 13 functions also as a guide member of this rotating film 12. Reference numeral 13*b* (FIG. 4) denotes a rib in the film rotation direction provided by forming spaces along the longitude on the outer surface of the side wall portion of this stay 13. By the presence of this rib, the sliding resistance between the stay side wall portion outer surface and the rotation film inner surface is reduced.

Besides, by interposing a lubricating agent such as heat-resisting grease or the like between the facing-down surface of the heater 17 and the inner surface of the film 12, the rotation of the above film 12 can be made smoother.

In a state wherein the pressure roller 9 is rotated and driven, attendant upon this, the cylindrical film 12 becomes in a rotation state, the heater 17 is electrified as described later, and the fixing nip portion N rises to a predetermined temperature by heat generation of said heater 17 to be temperature-adjusted, the transferring material sheet 11 bearing the unfixed toner image 10 is introduced between the film 12 of the fixing nip portion N and the pressure roller 9, and, in the fixing nip portion N, the toner image carrying surface side of the transferring material sheet 11 comes into close contact with the outer surface of the film 12 and sandwich-transferred in the fixing nip portion N together with the film. In this sandwich-transferring process, the heat of the heater 17 is given to the transferring material sheet 11 through the film 12, and the unfixed toner image 10 on the transferring material sheet 11 is heated, melted, and fixed. After the transferring material sheet 11 passes through the fixing nip portion N, it is curvature-separated from the outer surface of the rotating film 12 and transferred.

(3) Conductive Board Heater 17

Figure 3A:
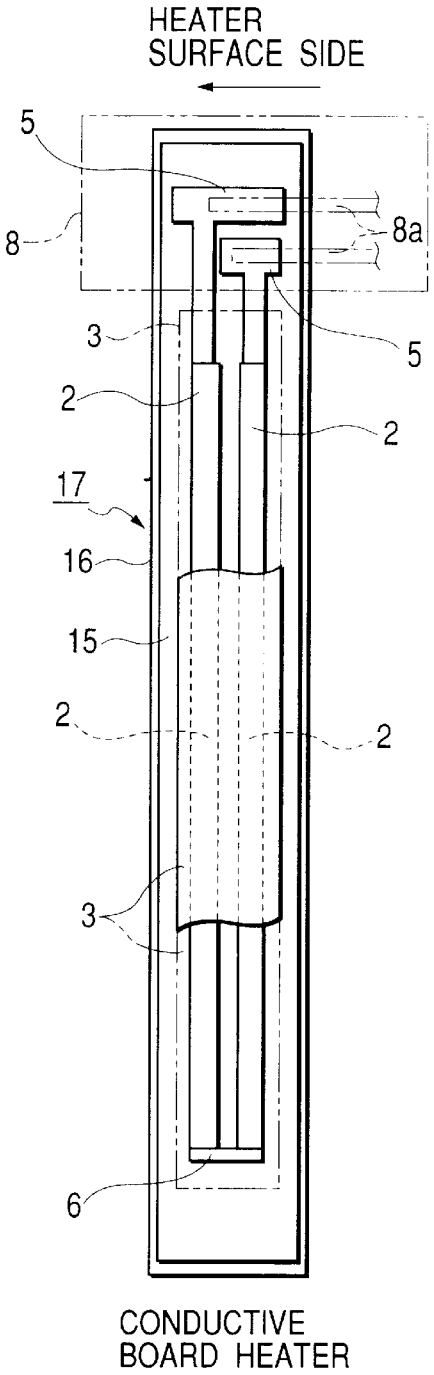
FIGS. 3A, 3B and 3C are model views showing the construction of a conductive board heater.
Figure 3B:
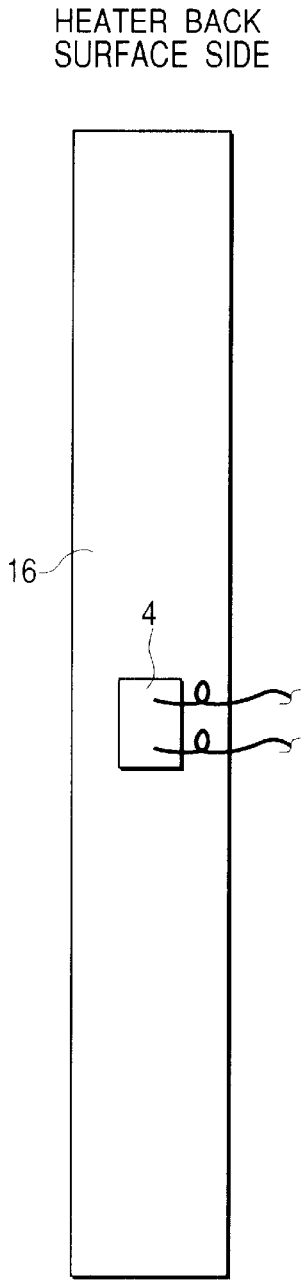
Figure 3C:
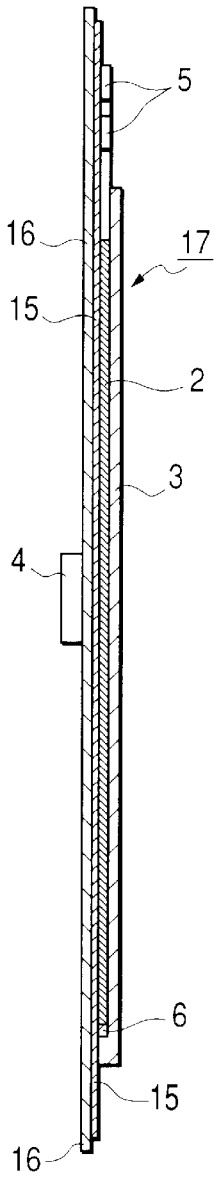

FIG. 3A is a partially cut-off plan model view on the surface side of the conductive board heater 17 of this example, FIG. 3B is a plan model view on the back surface side, and FIG. 3C is a vertical sectional model view.

Figures 7A, 7B, 7C:
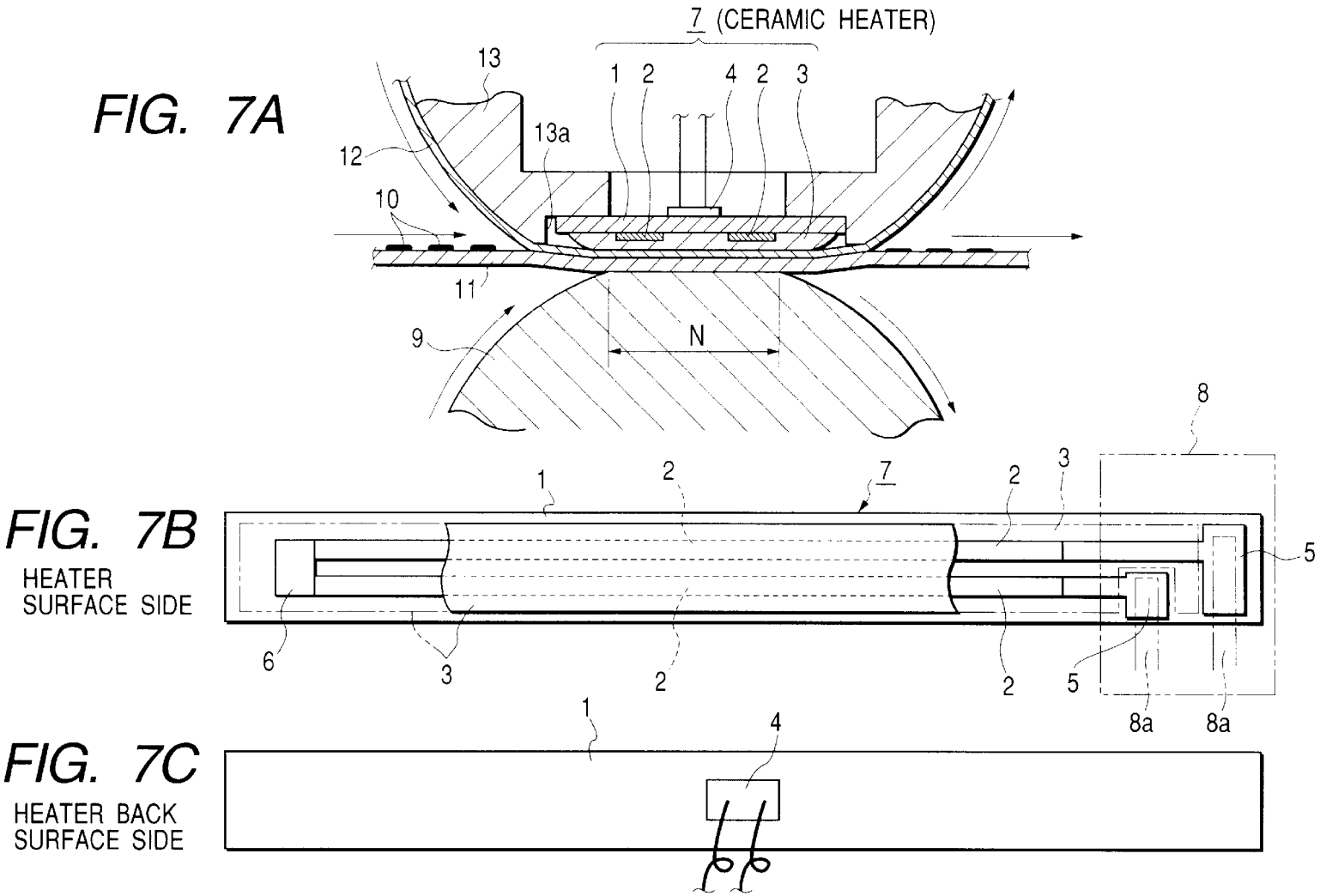
FIGS. 7A, 7B and 7C are illustrations of a heating apparatus of a film heating type and an example of a ceramic heater.

This heater 17 forms an insulating glass layer 15 as a first insulating layer in almost the whole region of the surface of a conductive substrate (conductor substrate) 16. And, on this insulating glass layer 15, substantially similarly with the ceramic heater 7 of FIGS. 7A to 7C described before, first and second parallel two-stripe narrow-band-shape electrification heat-generation resistor patterns 2, conductor patterns 5 as first and second power supply electrodes, a conductor pattern 6 as a folded-back electrode, and a heater surface protective glass layer 3 as a second insulating layer are formed and comprised.

For the conductive substrate 16, metal or the like such as SUS 430 whose coefficient of thermal expansion is easy to be matched to that of glass, is used. The length of said substrate 16 is desirable to be 270 mm, the width is desirable to be from 5 mm to 15 mm, and the thickness is desirable to be from 0.5 mm to 2 mm. If too thin, a great warp is generated after printing due to the difference in coefficient of thermal expansion and it becomes difficult to assembly. Besides, if too thick, the heat capacity of the heater becomes large, and, in case of abutting a thermistor or the like from the back surface, the response is delayed and a desirable control becomes difficult. This causes the generation of image problems such as fixing defect, luster unevenness, and offset.

For having a withstand voltage of 1.5 kV or more, the insulating glass layer 15 as the first insulating layer is formed into a thickness from 30 microns to 100 microns, and for preventing a pinhole, it is preferable to take a method of printing a plurality of times. Besides, to increase the adhesive performance between the conductive substrate 16 and this insulating glass layer 15, the conductive substrate 16 is roughing-processed by sand blast, etching, or the like, and after degreasing, the insulating glass layer 15 may be printed. Since this insulating glass layer 15 serves for not only the withstand voltage but also preventing the heat generated in the resistor patterns 2 from escaping to the substrate 16 side, the coefficient of thermal conductivity is preferably equal to or less than 2 W/m.K.

Further, on this insulating glass layer 15, the resistor patterns 2 and the conductor patterns 5, 6 are printed. An enough length of the resistor patterns is required to cover a width of a letter size paper, 216 mm.

Further, as the uppermost layer, the heater surface protective glass layer 3 is printed as the second insulating layer. For this protective glass 3, smoothness for slidability with the film 12 is required and insulating performance and a high thermal conductivity (preferably, equal to or more than 2 W/m.K or more) are required.

Ones such as the above glass layer, resistor patterns, and conductor pattern are made by baking after printing using screen printing, like the conventional ceramic heater.

Here, when the glass transition point (glass transition temperature) of the insulating glass layer 15 as the first electrically insulating layer formed on the conductive substrate 16 of the heater is defined as T1 and the glass transition point of the resistive element pattern layer 2 formed thereon and the conductive pattern layer 14 for effecting the supply of electric power to the resistive element pattern is defined as T2 and the glass transition point of the surface protecting insulating glass layer 3 as the second electrically insulating layer formed thereon is defined as T3, design is made such that the relation among the glass transition points of the respective layers is $T1>T3\geqq T2$.

T1 is selected to 850 degrees or higher, and T2 and T3 are selected to 800 degrees or higher and less than 850 degrees.

When printing and sintering are to be repeated to thereby form the patterns, it is preferable to make T2 higher than T3. This is because if the glass transition point of a layer printed on an already printed layer is higher than the glass transition point of the already printed layer, the layer printed and sintered earlier may be melted and diffuse into the layer printed later. In the present embodiment, however, this problem is solved by adding a filler such as alumina or metal salt to the paste of the resistive element layer to thereby up the viscosity during the melting, and making it difficult for the two to mix with each other even if the electrically insulating layer is sintered on the resistive element layer.

In the result, when the heater becomes out of control, the resistive element pattern 2 begins to melt at the glass transition point temperature T2 at first, and then the surface protecting insulating glass layer 3 which is the uppermost layer reaches the glass transition point T3, whereupon softening begins and the resistive element pattern 2 enter into this layer and as the result, the cross-sectional area of the original resistive element pattern 2 is partly decreased and that part is burned out and the electric current is cut off. This is the end of the heater out of control.

Figure 5A:
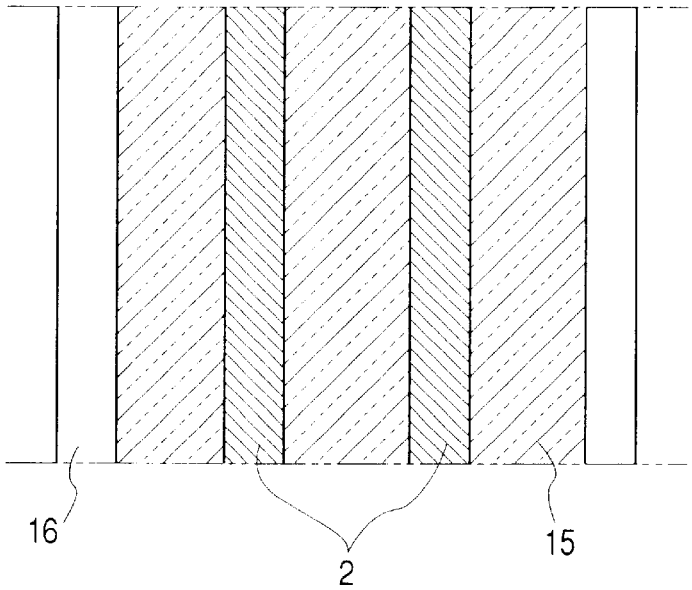
FIGS. 5A and 5B are illustrations of the self-breakage when the heater is out of control.
Figure 5B:
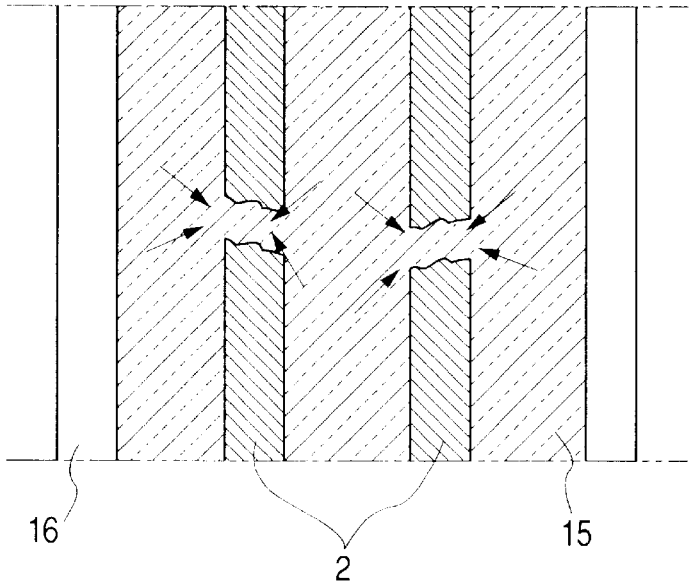

This state is shown in FIGS. 5A and 5B. FIG. 5A is a partly cut-away view of the heater in a normal state, and the surface protecting insulating glass layer 3 which is the uppermost layer is not shown therein. FIG. 5B shows the state when the heater is control, and a part of the resistive element pattern 2 is burned out and the surface protecting insulating glass 3 around it can enter as indicated by arrows and cover the end portion of the resistive element pattern 2 after burned out thereby secure an insulative property. Accordingly, when the resistive element pattern 2 is broken and the temperature begins to fall, the insulative property rises and the conduction can be stopped completely.

Figure 6A:
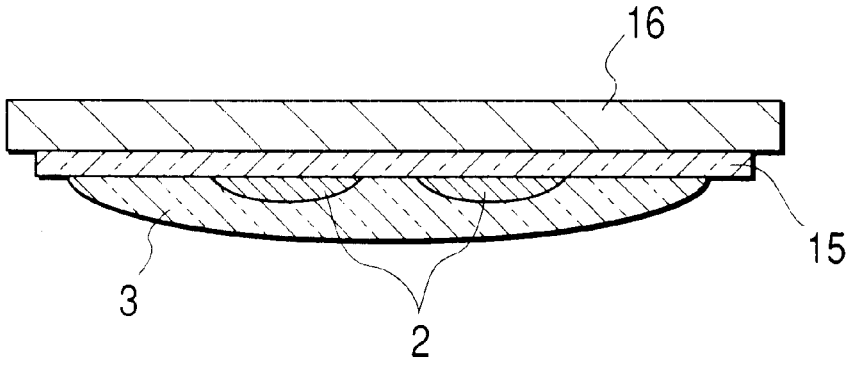
FIGS. 6A and 6B are illustrations of Embodiment 2.
Figure 6B:
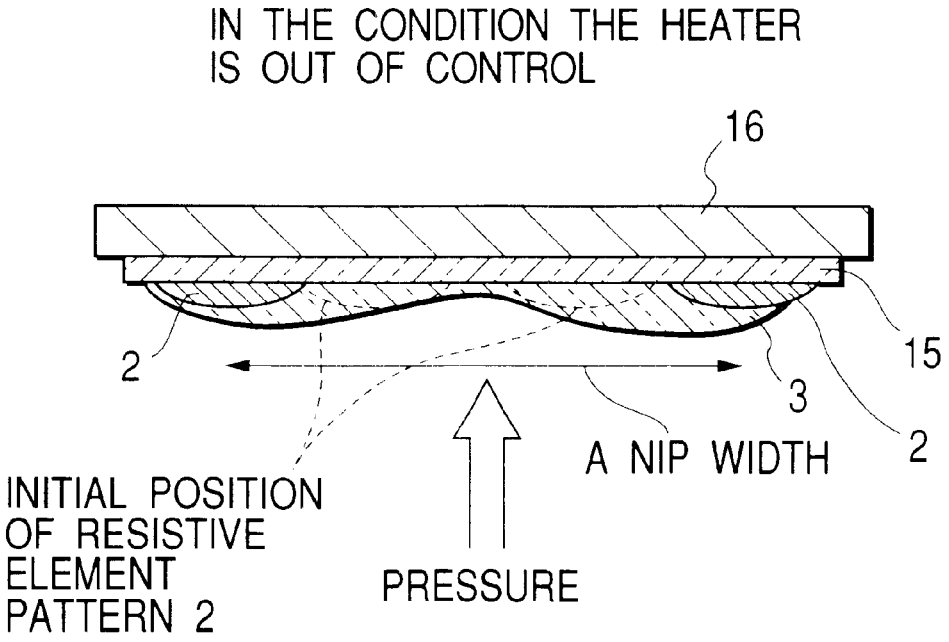

Embodiment 2 (FIGS. 6A and 6B)

Embodiment 2 relates to the positional relation between the heater 17 in the aforedescribed Embodiment 1 and the nip N formed by the pressure roller 9.

A pressure member such as a pressure roller is adapted to press substantially the center between two resistive element patterns 2 in the nip N as indicated by an upward arrow in FIG. 6B. In the result, when the heater becomes out of control and the resistive element patterns 2 are melted and further, a surface protecting insulating glass layer 3 on the surface begins to soften, whereupon the resistive element patterns 2 are forced out from their normal position as shown in FIG. 6A to the outward directions of the nip as shown in FIG. 6B, whereby breakage occurs between the patterns remaining at the position of broken line (the position before the heater is out of control) and the electric current no longer flows. This is the end of the heater out of control.

When the number of the resistive element patterns 2 is one, it is preferable that pressure be applied to the center thereof, but when there are a plurality of resistive element patterns 2, it is preferable in order to prevent the molten resistive element patterns 2 from being again connected to each other that the center of pressurization be designed to lie substantially on the center therebetween as shown in FIG. 6.

In a state in which the heater is thus assembled to a heating apparatus, even if the glass transition point of the insulating glass 3 on the surface is low, heat is diffused to the contacting member such as the pressure roller and the temperature thereof does not rise as compared with the resistive element patterns 2 and therefore, it never happens that the surface glass layer is melted earlier than the resistive element patterns. Accordingly, $T1>T2\geqq T3$ can be kept and therefore, there is not the problem of the diffusion and mixing of the resistive element patterns 2 and the insulating glass 3 on the surface which is the problem during the manufacture of the heater of the aforedescribed Embodiment 1.

Others

1) In a heating apparatus of a film heating type, there can be provided an apparatus construction in which endless belt-shaped film is stretched round with tension imparted thereto and is rotatively driven. There can also be provided an apparatus construction in which a roll of long film having ends is used so that it is moved at a predetermined speed from a pay-out spool side to a take-up spool side via a heater.

2) Of course, the heating member of the present invention can be applied not only to the heating apparatus of the film heating type, but also to a heating apparatus in which a heating member supported by a heating member supporting member is brought into direct contact with a material to be heated and thereby heats the material to be heated, etc.

3) Of course, the heating apparatus of the present invention can be used not only as an image heating and fixing apparatus, but also, for example, as an image heating apparatus for heating a recording material bearing an image thereon to thereby improve the surface property thereof such luster, an image heating apparatus for executing the tentative fixing process, a heating apparatus for feeding a sheet-like material and effecting the drying process and the laminating process thereon, a heater used in a heating apparatus for drying used in an ink jet printer or the like, or a heating apparatus using such heater.

The present invention is not restricted to the above-described embodiments, but covers modifications identical in technical idea with the present invention.

What is claimed is:

1. A heater comprising:

an electrically conductive substrate;

a first electrically insulating layer formed on said electrically conductive substrate;

a heat generating resistor formed on said first electrically insulating layer; and a second electrically insulating layer formed on said heat generating resistor;

wherein, in case that glass transition temperatures of said first electrically insulating layer, said heat generating layer, and said second electrically insulating layer are respectively defined as T1, T2 and T3, T1, T2 and T3 have a relation that $T1>T3\geqq T2$ or $T1>T2\geqq T3$.

2. A heater according to claim 1, wherein said first electrically insulating layer is a glass layer.

3. A heater according to claim 2, wherein said second electrically insulating layer is a glass layer.

4. A heater according to claim 1, further comprising an electrode for supplying electric power to said heat generating resistor, said electrode being formed on said first electrically insulating layer.

5. An image heating apparatus comprising:

a heater comprising an electrically conductive substrate, a first electrically insulating layer formed on said electrically conductive substrate, a heat generating resistor formed on said first electrically insulating layer, and a second electrically insulating layer formed on said heat generating resistor; and a backup member for forming nip cooperation with said heater, wherein, in case that glass transition temperatures of said first electrically insulating layer, said heat generating resistor and said second electrically insulating layer are respectively defined as T1, T2 and T3, T1, T2 and T3 have a relation that $T1>T3\geqq T2$ or $T1>T2\geqq T3$.

6. An image heating apparatus according to claim 5, wherein said first electrically insulating layer is a glass layer.

7. An image heating apparatus according to claim 6, wherein said second electrically insulating layer is a glass layer.

8. An image heating apparatus according to claim 5, wherein said heater further comprises an electrode for supplying electric power to said heat generating resistor, said electrode being formed on said first electrically insulating layer.

9. An image heating apparatus according to claim 5, wherein two heat generating resistors are formed on said electrically conductive substrate, and said backup member presses with the space between said two resistors as the center.

10. An image heating apparatus according to claim 5, wherein said heat generating resistor is formed on said electrically conductive substrate, and said backup member presses with said resistor as the center.

11. An image heating apparatus according to claim 5, further comprising a film being slidable relative to the heater, wherein an image on a recording material is heated by heat from the heater through the film.

* * * * *

UNITED STATES PATENT AND TRADEMARK OFFICE

CERTIFICATE OF CORRECTION

PATENT NO. : 6,518,546 B2
DATED : February 11, 2003
INVENTOR(S) : Yasumasa Otsuka et al.

It is certified that error appears in the above-identified patent and that said Letters Patent is hereby corrected as shown below:

Column 3,
Line 54, “like, and the like” should read -- like. --

Column 4,
Line 65, “T1 > T≧T3;” should read -- T1>T2≧T3; --.

Column 8,
Line 45, “diffuse” should read -- diffused --.

Signed and Sealed this

Twenty-eighth Day of October, 2003

JAMES E. ROGAN
*Director of the United States Patent and Trademark Office*